US007007646B2

(12) United States Patent
Takayasu et al.

(10) Patent No.: US 7,007,646 B2
(45) Date of Patent: Mar. 7, 2006

(54) VALVE GEAR WITH CYLINDER SUSPENDING MECHANISM OF AN INTERNAL COMBUSTION ENGINE

(75) Inventors: Norio Takayasu, Kyoto (JP); Toshihiko Oka, Anjyo (JP); Tetsushi Nagira, Toyota (JP); Satoshi Ando, Aichi (JP); Shinichi Murata, Okazaki (JP); Masanori Tokuhisa, Rittou (JP)

(73) Assignees: Mitsubishi Jidosha Kogyo Kabushiki Kaisha, Tokyo (JP); Mitsubishi Jidosha Engineering Kabushiki Kaisha, Aichi (JP)

( * ) Notice: Subject to any disclaimer, the term of this patent is extended or adjusted under 35 U.S.C. 154(b) by 0 days.

(21) Appl. No.: 10/941,974

(22) Filed: Sep. 16, 2004

(65) Prior Publication Data

US 2005/0092271 A1 May 5, 2005

(30) Foreign Application Priority Data

Sep. 18, 2003 (JP) ..... 2003-326790
Sep. 18, 2003 (JP) ..... 2003-326791

(51) Int. Cl.
*F01L 1/34* (2006.01)

(52) U.S. Cl. ..... 123/90.16; 123/90.15; 123/90.39

(58) Field of Classification Search ..... 123/90.39, 123/90.16, 90.15, 90.31
See application file for complete search history.

(56) References Cited

U.S. PATENT DOCUMENTS 6,053,135 A * 4/2000 Ochiai et al. ..... 123/90.16
6,330,869 B1 * 12/2001 Yoshiki et al. ..... 123/90.15

FOREIGN PATENT DOCUMENTS

JP 2001-41017 A 2/2001
JP 2002-201921 A 7/2002
JP 2002-227624 A 8/2002

* cited by examiner

*Primary Examiner*—Thomas Denion
*Assistant Examiner*—Zelalem Eshete
(74) *Attorney, Agent, or Firm*—Birch, Stewart, Kolasch & Birch, LLP

(57) ABSTRACT

A valve gear with a cylinder suspending mechanism of an internal combustion engine, whose entire valve gear mechanism is downsized by efficiently arranging the configuration of the valve gear including the cylinder suspending mechanism. A low-speed drive rocker arm and a high-speed drive rocker arm are disposed in front and at the rear of an intake driven rocker arm so that pistons of low-speed and high-speed cylinder portions arranged side by side in the intake driven rocker arm may be pressed by operating operation arm portions extending from the respective drive rocker arms, to thereby arrange the low-speed and high-speed cylinder portions and the low-speed and high-speed drive rocker arms around the intake driven rocker arm to gather in one place.

13 Claims, 8 Drawing Sheets

VALVE GEAR WITH CYLINDER SUSPENDING MECHANISM OF AN INTERNAL COMBUSTION ENGINE

CROSS-REFERENCE TO RELATED APPLICATIONS

This Nonprovisional application claims priority under 35 U.S.C. §119(a) on Patent Application Nos. 2003-326790 and 2003-326791 filed in Japan on Sep. 18, 2003, the entire contents of which are hereby incorporated by reference.

BACKGROUND OF THE INVENTION

1. Field of the Invention

The present invention relates to a valve gear with a cylinder suspending mechanism of an internal combustion engine (hereinafter referred to as engine).

2. Description of the Related Art

To realize the most suitable engine output characteristics according to an operation region, various types of engines, which perform the switching of the opening period or the lift amount of intake and exhaust valves, and the like, have been suggested (for instance, refer to Unexamined Japanese Patent Publication Nos. 2001-41017 and 2002-227624).

In the engine disclosed in Publication No. 2001-41017, a driven rocker arm supported by a rocker shaft is oscillated by a first cam to drive an intake valve to be open or close, and a drive rocker arm formed adjacent to the driven rocker arm and supported by the rocker shaft is oscillated by a second cam. A piston is fitted into a cylinder formed in the driven rocker arm so as to be slidable by hydraulic pressure, while in the drive rocker arm, an engaging projection that is engageable with the piston along with the oscillation is formed.

In a low revolution region of the engine, for instance, the piston of the driven rocker arm is switched to its lower position to cause the engaging projection of the drive rocker arm to strike at the air, to thereby open and close the intake valve along the shape of the first cam by using the driven rocker arm. In a high revolution area of the engine, on the contrary, the piston of the driven rocker arm is switched to its upper position to be pressed by the engaging projection of the drive rocker arm to oscillate the driven rocker arm with the drive rocker arm, to thereby open and close the intake valve along the shape of the second cam.

In the engine disclosed in Publication No. 2002-227624, a first rocker arm corresponding to a low-speed cam, a second rocker arm corresponding to a high-speed cam, and a third rocker arm corresponding to a suspension cam are supported in an intake-side rocker shaft, and a pair of intake valves is driven to open or close in liaison with the first and third rocker arms. There is provided a switch pin in each rocker arm to be slidable by hydraulic pressure in the axial direction of the rocker shaft. The rocker arms are connected with or disconnected from one another according to the sliding position of the switch pins.

In the low revolution region of the engine, for example, the connections of the rocker arms are released by the switch pins. One of the intake valves is driven to be open or close along the low-speed cam through the first rocker arm, and the other intake valve is practically kept closed by the suspension cam through the third rocker arm. In the high revolution region of the engine, the rocker arms are connected by the switch pins, and all the rocker arms are integrally oscillated by the high-speed cam to drive both the intake valves to be open or close along the high-speed cam.

As described above, in the engine disclosed in Publication No. 2001-41017, the switching is carried out in two operation states in each of which the intake valve is driven to be open or close by means of a corresponding one of the first and second cams. In the engine disclosed in Publication No. 2002-227624, the switching is performed in two operation states in one of which the intake valves are driven to be open or close by the low-speed cam and the suspension cam and in the other of which the intake valves are driven to be open or close by the high-speed cam. It has been desired to provide a cylinder suspending function for suspending certain cylinders in addition to the above-stated functions.

To add the cylinder suspending function, however, it is required to add a mechanism for stopping the oscillation of the rocker arms connected to the intake valves (namely the driven rocker arm in Publication No. 2001-41017 and the first and third rocker arms in Publication No. 2002-227624). This generates a problem that, with technologies disclosed in Publication Nos. 2001-41017 and 2002-227624, the entire valve gear would be enlarged in size as the configuration thereof becomes complicated.

A valve gear with a cylinder suspending mechanism requires that intake and exhaust valves of suspending cylinders be kept closed. For instance, as for an SOHC-type engine in which intake and exhaust valves are driven to open or close by a single camshaft, a circular suspension cam is provided on the camshaft, and intake and exhaust rocker arms are brought into contact with the suspension cam when cylinders are inoperative, to thereby hold the intake and exhaust valves closed. It is required in such an engine to form as many suspension cams as rocker arms on the camshaft. This causes problems, however, that the camshaft has to be long in its entire length, that the manhours of processing the camshaft are increased, and so on. Therefore, countermeasures against these problems have been suggested (refer to Unexamined Japanese Patent Publication No. 2002-201921 (FIG. 2)).

Publication No. 2002-201921 discloses an engine in which intake-side and exhaust-side rocker shafts each support a pair of drive rocker arms corresponding to a pair of intake and exhaust valves. According to the sliding movement of switch pins, the drive rocker arms are connected with or disconnected from their respective free rocker arms that are each oscillated by an intake cam, real suspension cam, and exhaust cam of a camshaft, to thereby arbitrarily open and close the intake and exhaust valves. The intake-side and exhaust-side drive rocker arms are located such that the intake-side drive rocker arms substantially correspond to their respective exhaust-side drive rocker arms in the axial direction of the rocker shaft, and a pair of suspension cams is formed on the camshaft so as to be located in between the corresponding intake and exhaust drive rocker arms. At the time of cylinder suspension, the corresponding intake and exhaust drive rocker arms are brought into contact with the common suspension cam, to thereby keep the intake and exhaust valves closed.

In an engine disclosed in Unexamined Japanese Patent Publication No. 2002-201921, suspension cams are reduced in number by half by providing a common suspension cam to intake and exhaust drive rocker arms. On the other hand, however, a pair of suspension cams is indispensable per cylinder due to constraints on layout of a cylinder suspending mechanism.

More specifically, as illustrated in FIG. 2 of the publication, a free rocker arm oscillated by an intake cam is disposed in between a pair of intake-side drive rocker arms, and another free rocker arm oscillated by an exhaust cam is arranged in between a pair of exhaust-side drive rocker arms. Such layout makes it impossible to substitute a single suspension cam for a pair of suspension cams, that is, to bring all the intake and exhaust drive rocker arms into contact with the single suspension cam, since the free rocker arms and the intake and exhaust cams cause obstruction.

Accordingly, the engine disclosed in the publication requires that a pair of suspension cams be formed on the camshaft per cylinder, which discourages full achievement of reduction of a camshaft's entire length and a reduction in manhours of processing the camshaft.

SUMMARY OF THE INVENTION

The present invention providing provides a valve gear with a cylinder suspending mechanism of an internal combustion engine, whose entire valve gear mechanism is downsized by efficiently arranging the configuration of the valve gear including the cylinder suspending mechanism.

The valve gear with a cylinder suspending mechanism of an internal combustion engine according to the present invention comprises a first rocker arm having a tip end connected to either one of intake and exhaust valves and pivotably supported on a first rocker shaft, a second rocker arm located at one side of the first rocker arm, pivotably supported on the first rocker shaft, and driven by a first cam formed in a camshaft, a third rocker arm located at the other side of the first rocker arm, pivotably supported on the first rocker shaft, and driven by a second cam formed in the cam shaft and having a cam shape different from the first cam, a first switching mechanism for switching connection and disconnection of the first rocker arm with respect to the second or third rocker arm, and control means for controlling the switching of the first switching mechanism, in which the first switching mechanism includes a first piston slidably fitted into a first cylinder formed in the first rocker arm, a second piston slidably fitted into a second cylinder formed in the first rocker arm, a first engaging projection extending from the second rocker arm and formed to be engageable with the first piston, and a second engaging projection extending from the third rocker arm and formed to be engageable with the second piston, and the first and second pistons are switched between an engaging position and a non-engaging position with respect to the first and second engaging projections.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PRESENT INVENTION

A valve gear with a cylinder suspending mechanism of an engine according to an embodiment of the present invention will be described below.

The engine according to the present embodiment is constructed as a V-six cylinder gasoline engine having four valves per cylinder, and is designed to be capable of switching among a high-speed mode for realizing particularly high engine output, a low-speed mode for dealing with normal engine output, and a cylinder suspending mode for suspending cylinders located on one of two banks. Therefore, valve gears of both banks each have a switching mechanism for switching the low-speed mode and the high-speed mode, and one of the banks is provided with a cylinder suspending mechanism. First of all, an explanation will be provided about a configuration of the bank having the cylinder suspending mechanism (hereinafter referred to as a suspension cylinder bank, and the opposite one as a non-suspension cylinder bank).

Suspension Cylinder Bank

Figure 1:
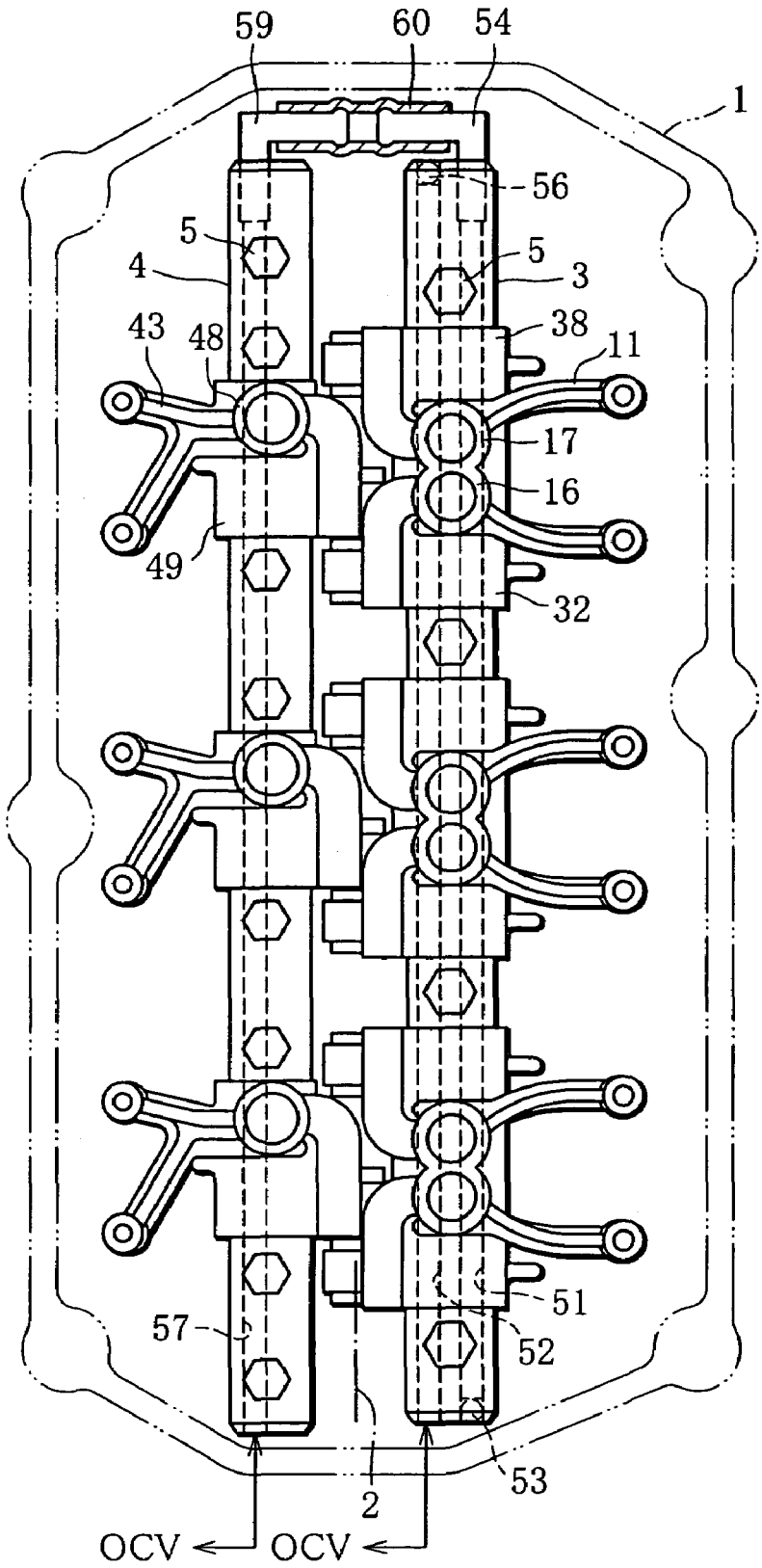
FIG. 1 is a plan view showing a cylinder head having a valve gear with a cylinder suspending mechanism of an engine according to one embodiment.

FIGS. 1 through 8 show a cylinder head of the suspension cylinder bank. It is assumed here that the upper and lower direction in FIG. 1 represents the longitudinal direction of the engine, the right side of the cylinder head is an intake side, and the left side is an exhaust side. There is disposed a cylinder head of the non-suspension cylinder bank on the right of the cylinder head of the suspension cylinder bank.

Figure 2:
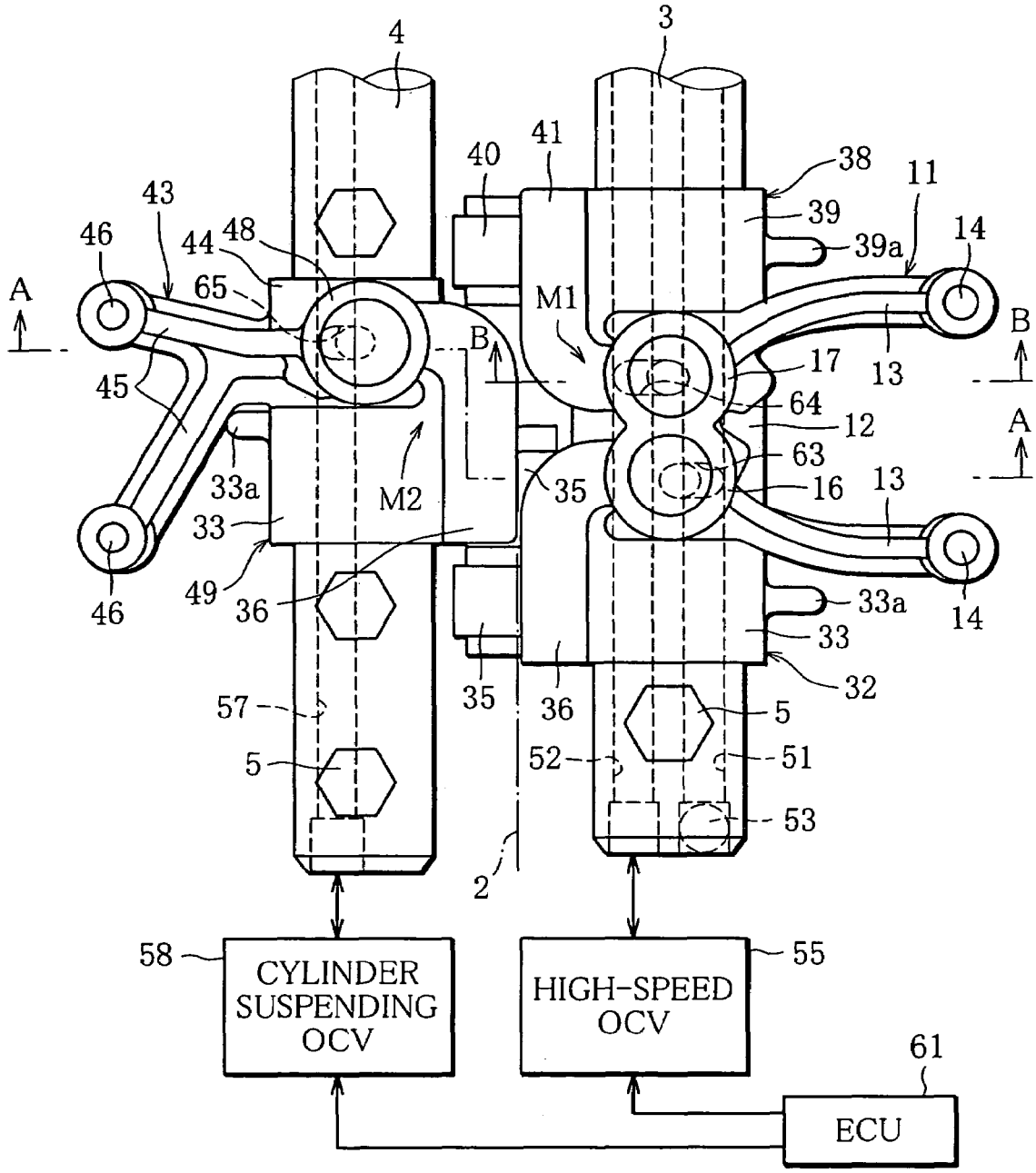
FIG. 2 is an enlarged partial plan view showing details of the valve gear for one cylinder.
Figure 7:
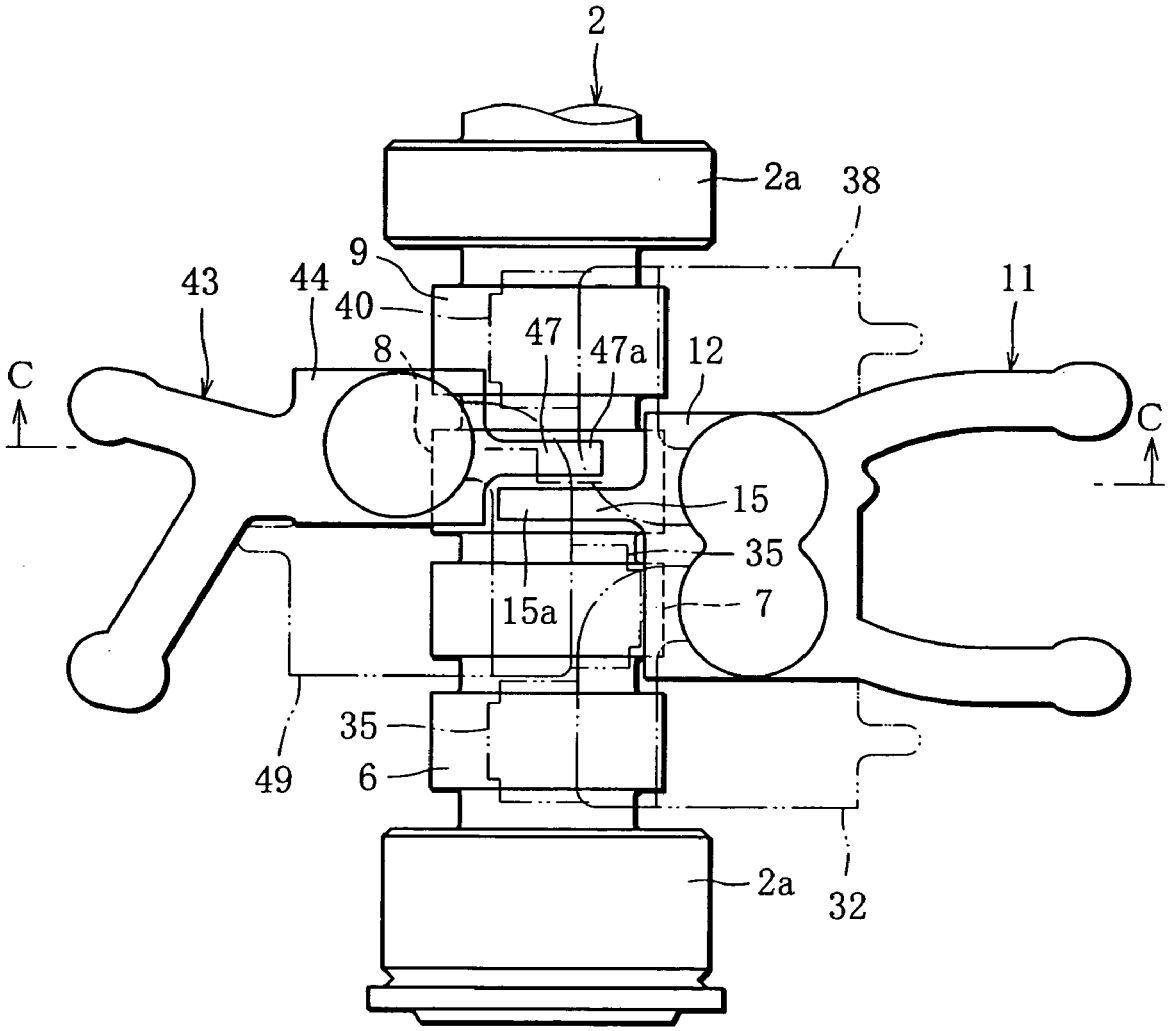
FIG. 7 is an enlarged partial plan view showing the positional relation of drive rocker arms and driven rocker arms with respect to the cams.

As illustrated in FIGS. 2, and 7, a camshaft 2 of the valve gear is disposed in the substantial middle of a cylinder head 1 to extend in a longitudinal direction. The camshaft 2 has journal portions 2*a* supported by respective cylinder head journals, not shown, to be driven by a crankshaft to rotate in synchronization. An intake rocker shaft 3 (first rocker shaft) is arranged on the upper right side of the camshaft 2, and an exhaust rocker shaft 4 (second rocker shaft) on the upper left side of the camshaft 2. The rocker shafts 3 and 4 are appropriately fixed onto the cylinder head 1 with bolts 5 in parallel with the camshaft 2.

Cylinders are arranged in a row along the camshaft 2 in the longitudinal direction. The valve gear for one of the cylinders will be described below, and it should be noted that the valve gears for the other cylinders each have the identical configuration. As shown in FIG. 7, formed in between two adjacent journal portions 2*a* of the camshaft 2 are cams for one cylinder, including a low-speed-side intake cam 6 (first cam, and hereinafter abbreviated as low-speed cam), an exhaust cam 7 (third cam), a suspension cam 8 (fourth cam), and a high-speed-side intake cam 9 (second cam, and hereinafter abbreviated as high-speed cam) arranged in the order named from the front side. Configurations of intake-side and exhaust-side valve gears driven by the cams 6 through 9 and configurations of oil paths for switching the valve gears will be described below in due order.

Intake-Side Valve Gear

Figure 3:
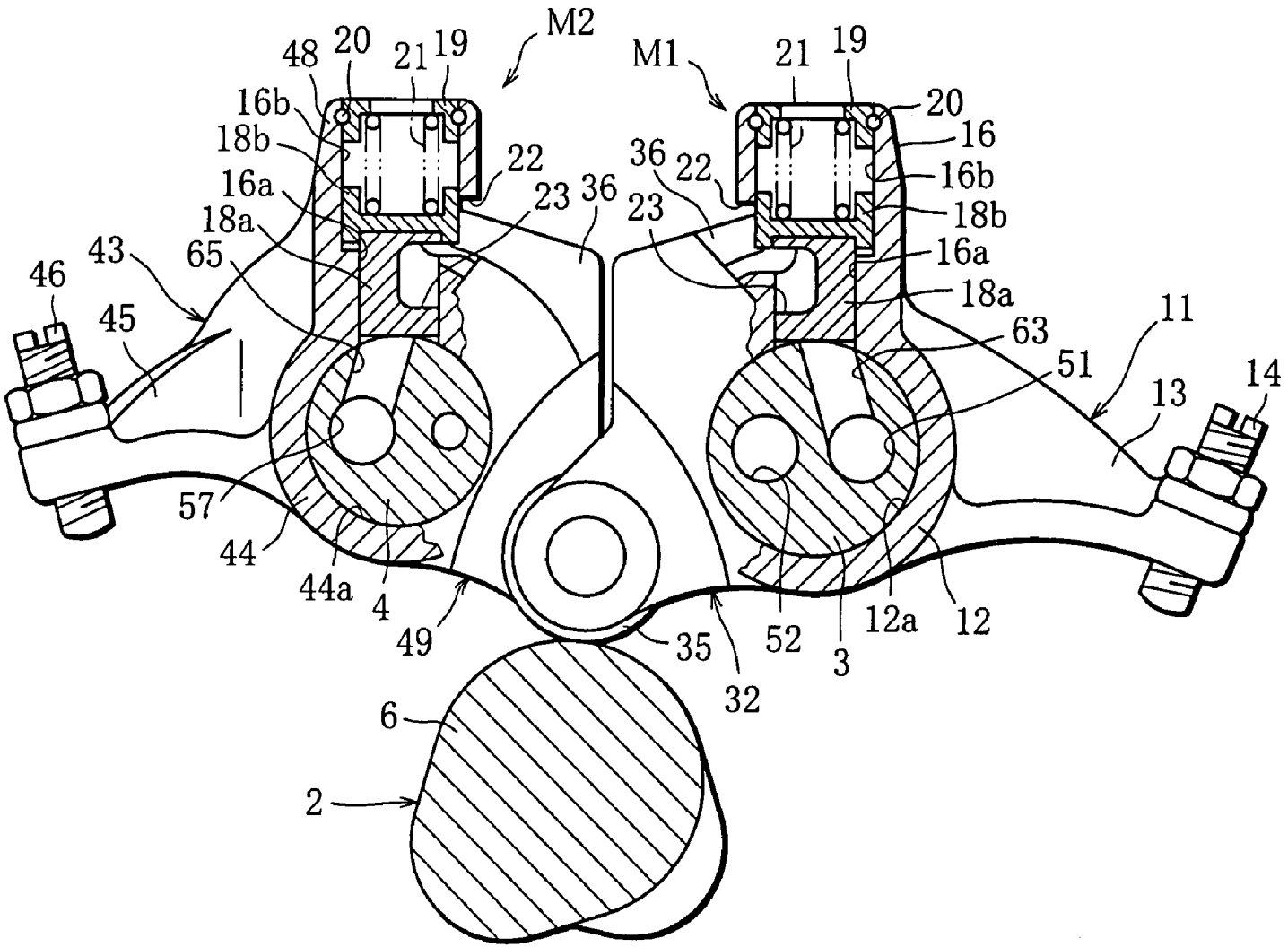
FIG. 3 is a cross-sectional view taken along line A—A of FIG. 2, showing an operating state of a low-speed cam and an exhaust cam.

As illustrated in FIGS. 2 and 3, the intake rocker shaft 3 is fitted in a bearing bore 12*a* formed in a boss portion 12 of an intake driven rocker arm 11 (first rocker arm), and the entire intake driven rocker arm 11 can be oscillated around the intake rocker shaft 3. Two valve-side arm portions 13 formed into a biforked shape extending from the boss portion 12 (first support portion) in a rightward direction. Provided to a tip end of each valve-side arm portion 13 is an adjust bolt 14 for valve clearance adjustment, which corresponds to an intake valve, not shown, located on the cylinder head 1.

Figure 8:
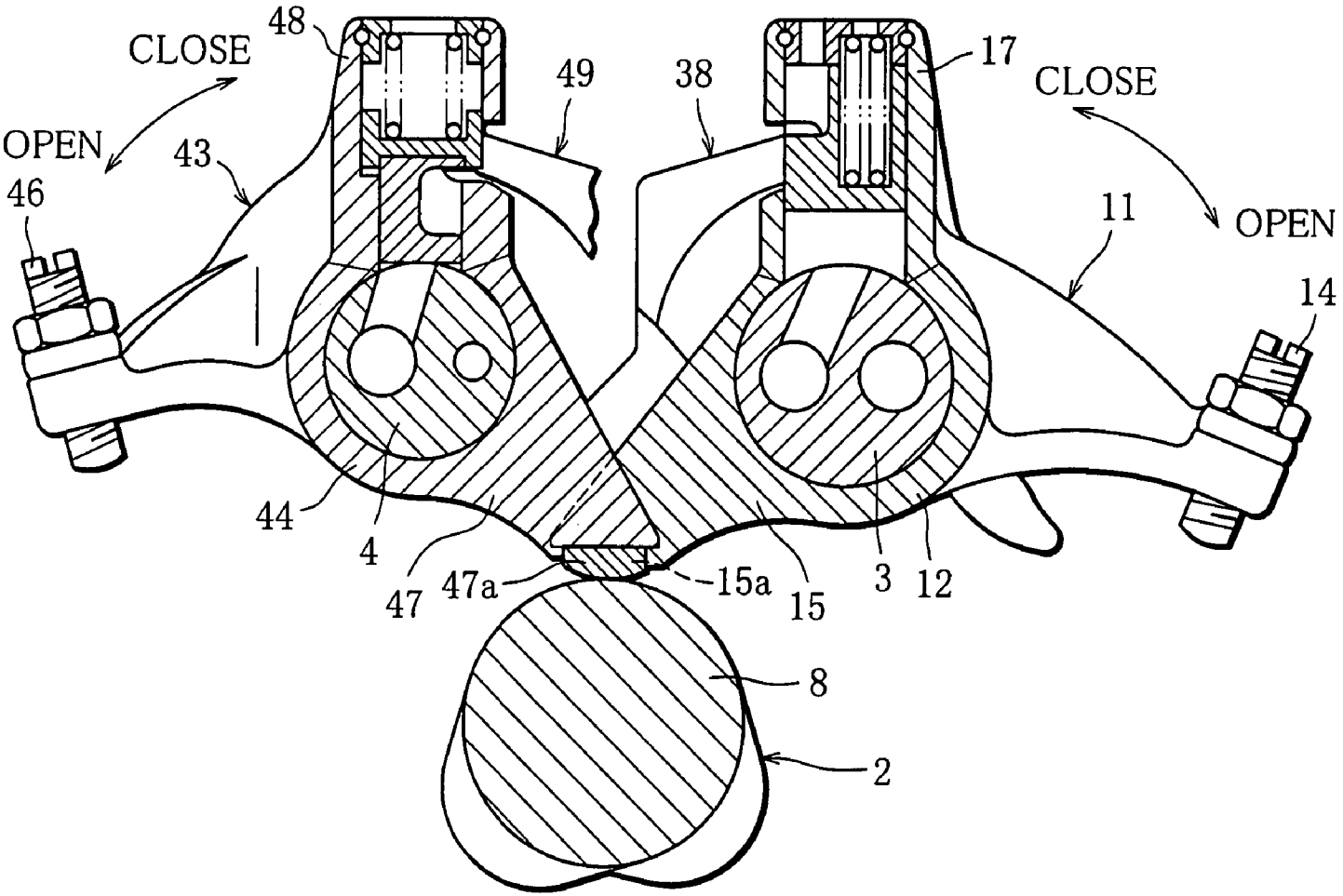
FIG. 8 is a cross-sectional view taken along line C—C of FIG. 7.

Referring to FIGS. 7 and 8, a cam-side arm portion 15 (first contact portion) extends from the boss portion 12 in a leftward direction, and a sliding-contact portion 15*a* formed in a tip end of the cam-side arm portion 15 is in contact with the suspension cam 8. If the intake driven rocker arm 11 is oscillated clockwise while the sliding-contact portion 15*a* of the cam-side arm portion 15 is in contact with the suspension cam 8, the intake valves are opened against valve springs through the adjust bolts 14 of the valve-side arm portions 13. Hereinafter, an oscillating direction of members constructing the intake-side valve gear, including the intake driven rocker arm 11, an after-mentioned low-speed drive rocker arm 32, an after-mentioned high-speed drive rocker arm 38 and the like, is defined as a valve-opening direction if the oscillating direction is clockwise, and a valve-closing direction if counterclockwise.

Figure 5:
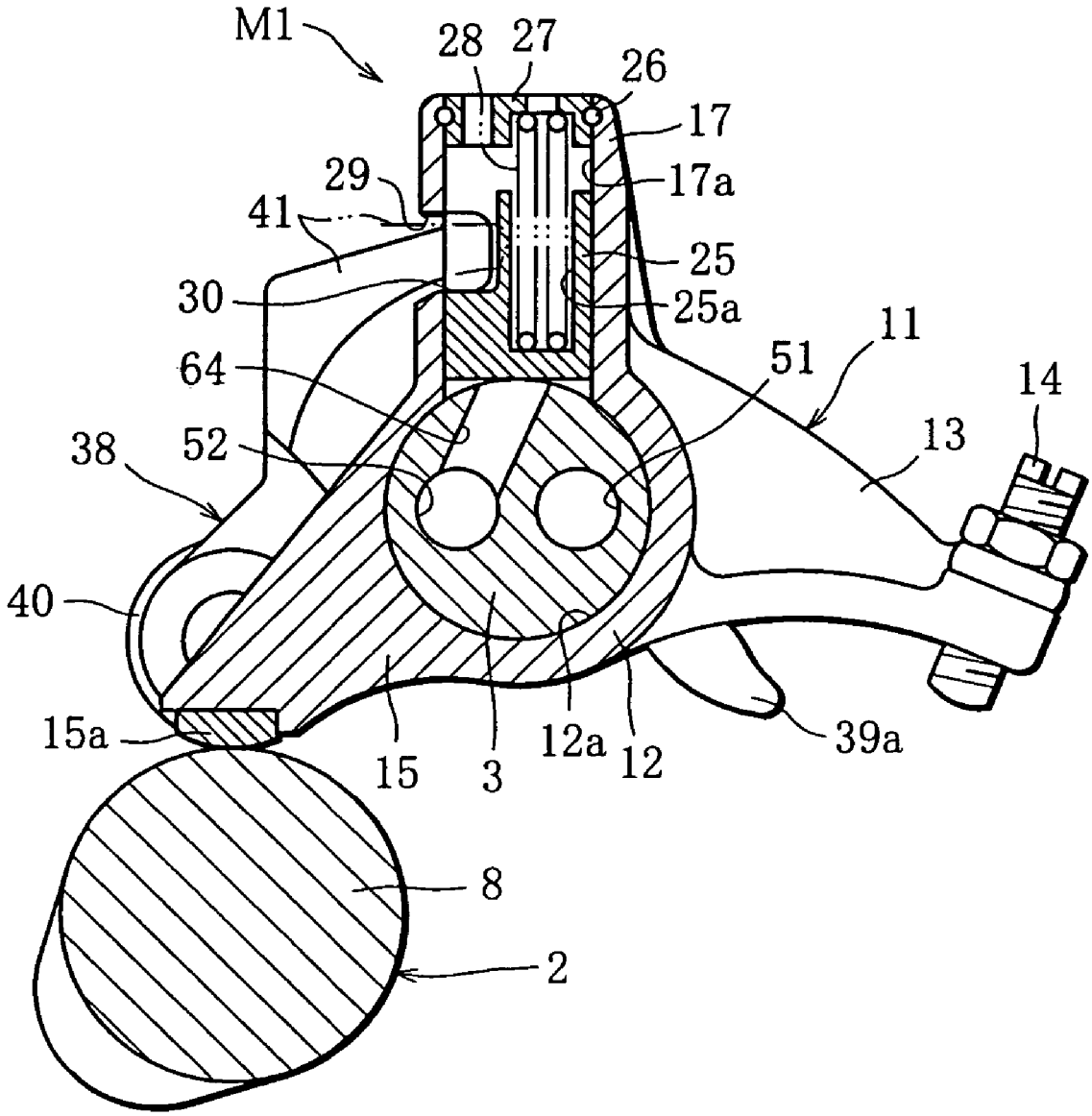
FIG. 5 is a cross-sectional view taken along line B—B of FIG. 2, showing a suspending state of a high-speed cam.

As illustrated in FIGS. 2, 3, and 5, on the boss portion 12 of the intake driven rocker arm 11, a cylindrical low-speed cylinder portion 16 and a cylindrical high-speed cylinder portion 17 are integrally formed alongside. Formed in the low-speed cylinder portion 16 is a lower cylinder 16*a* (one half portion of a first cylinder) with a small diameter and an upper cylinder 16*b* (the other half portion of the first cylinder) with a large diameter, each having a circular shape in section. The lower cylinder 16*a* and the corresponding upper cylinder 16*b* are formed continuously in a vertical direction. The lower cylinder 16*a* has a lower end that is open in an inner circumferential surface of the bearing bore 12*a* of the boss portion 12, and the upper cylinder 16*b* has an upper end that is open upward.

Disposed in the lower cylinder 16*a* is a lower piston 18*a* (a second portion of a first piston). The lower piston 18*a* can slide in the lower cylinder 16*a* in the vertical direction while being restricted in rotation around the axis of the lower cylinder 16*a* by a restriction pin, not shown. In the upper cylinders 16*b*, there is located an upper piston 18*b* (a first portion of the first piston), which is also slidable in the upper cylinder 16*b* in the vertical direction. The upper piston 18*b* is made of a material having higher rigidity than a material used for the lower piston 18*a*.

Figure 4:
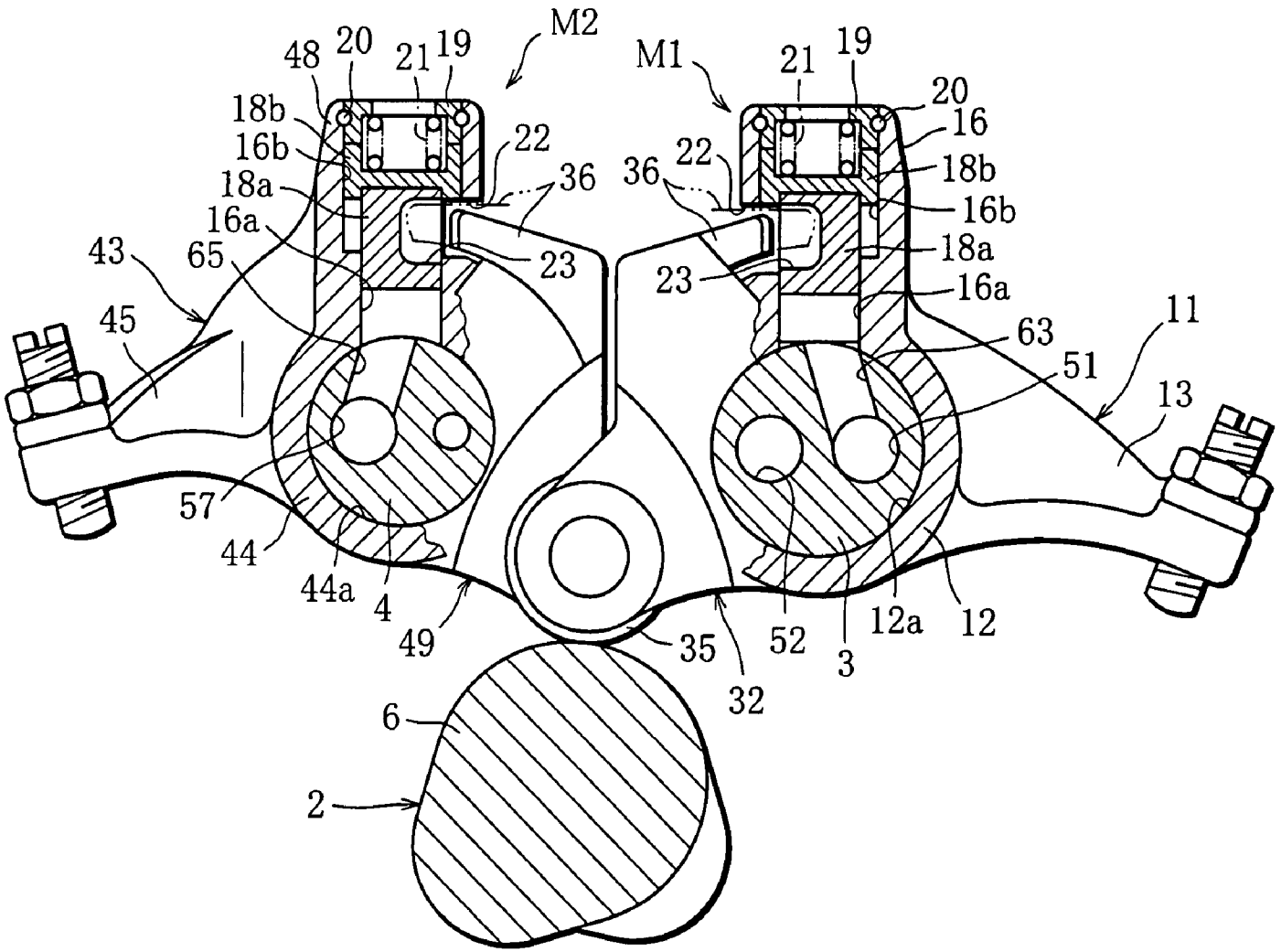
FIG. 4 is a cross-sectional view taken along line A—A of FIG. 2, showing a suspending state of the low-speed cam and the exhaust cam.

A cap 19 is pressed into an opening of the upper cylinder 16*b* and prevented by a snap ring 20 from being detached therefrom. In the upper cylinder 16*b*, there is interposed a compression spring 21 between the cap 19 and the upper piston 18*b*. As shown in FIG. 3, the lower piston 18*a* and the upper piston 18*b* are downwardly biased by the compression spring 21 all the time, thereby being held in respective lower positions (engaging positions) which bring a lower surface of the lower piston 18*a* into contact with an outer circumferential surface of the intake rocker shaft 3. As illustrated in FIG. 4, when the lower piston 18*a* and the upper piston 18*b* slide upward from the lower positions in the cylinders 16*a* and 16*b*, resisting the compression spring 21, an upper portion of the upper piston 18*b* is brought into contact with a lower portion of the cap 19. Accordingly, the lower piston 18*a* and the upper piston 18*b* are switched to respective upper positions (non-engaging positions).

An operation window 22 is formed in a left surface of the low-speed cylinder portion 16, that is, in a side facing the camshaft 2, and a run-off 23 is formed as a recess in a left surface of the lower piston 18*a*. When the pistons 18*a* and 18*b* are in the upper positions shown in FIG. 4, the run-off 23 of the lower piston 18*a* is exposed leftward through the operation window 22. In the lower positions shown in FIG. 3, an outer circumferential surface of the upper piston 18*b* is exposed leftward through the operation window 22.

Referring to FIG. 5, a cylinder 17*a* (second cylinder) having a circular shape in section is formed in the high-speed cylinder portion 17 in the vertical direction. The cylinder 17*a* has a lower end that is open in the inner circumferential surface of the bearing bore 12*a* of the boss portion 12 and an upper end that is open upward fitted in the cylinder 17*a* is a piston 25 (second piston). The piston 25 can slide in the cylinder 17*a* in the vertical direction while being restricted in rotation around the axis of the cylinder 17*a* by a restriction pin, not shown. The piston 25 is made of the same material as one used for the upper piston 18*b* of the low-speed cylinder portion 16, to thereby secure equivalent rigidity.

Figure 6:
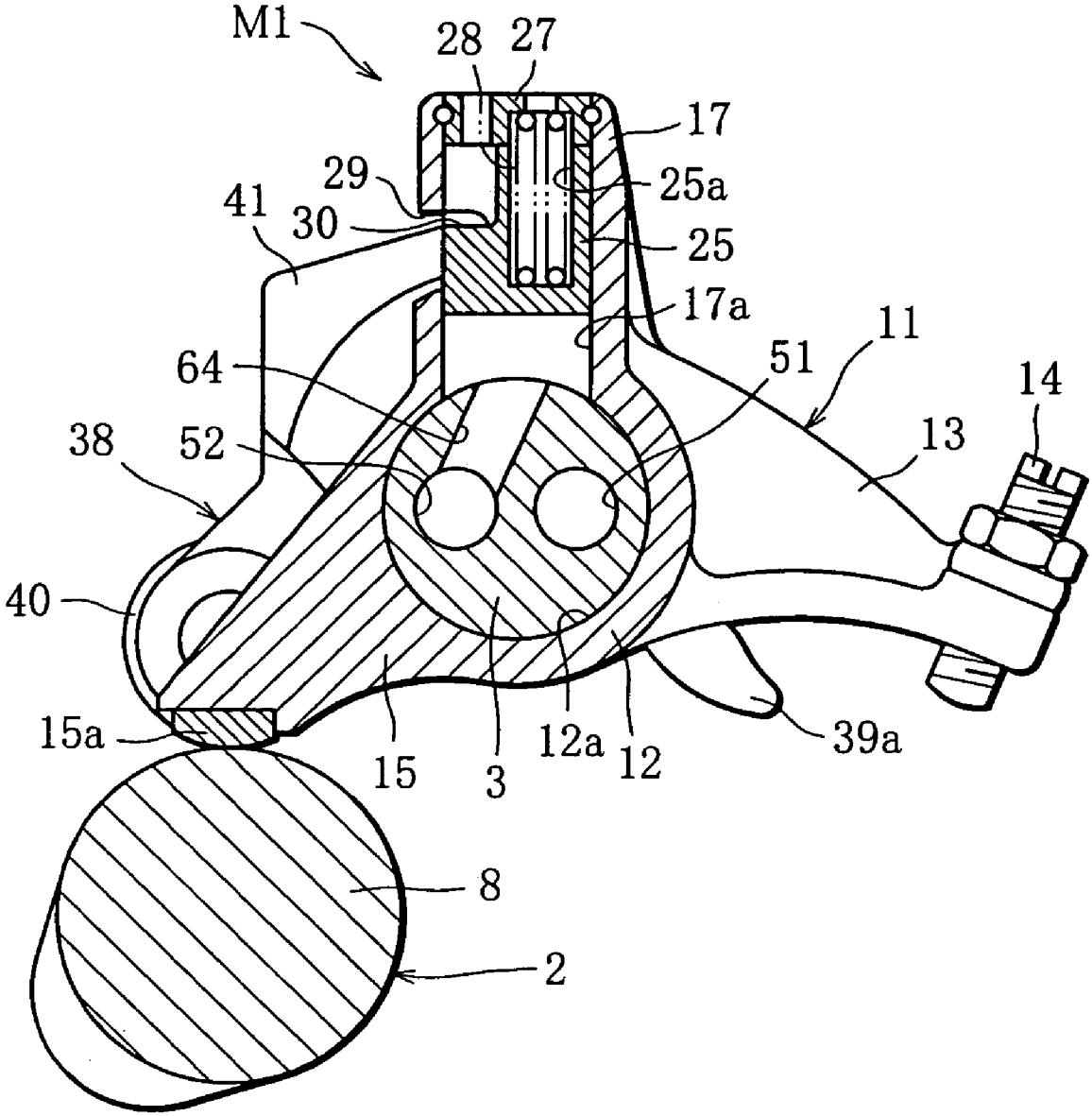
FIG. 6 is a cross-sectional view taken along line B—B of FIG. 2, showing an operating state of the high-speed cam.

As is the case with the low-speed cylinder portion 16, a cap 27 is fitted in an opening of the cylinder 17*a* with a snap ring 26, and a compression spring 28 is interposed between the cap 27 and the piston 25. As illustrated in FIG. 5, the piston 25 is constantly biased in the downward direction by the compression spring 28 and maintained in a lower position (non-engaging position) which brings a lower surface thereof into contact with the outer circumferential surface of the intake rocker shaft 3. Referring to FIG. 6, when the piston 25 upwardly slides from the lower position in the cylinder 17*a*, resisting the compression spring 28, an upper portion of the piston 25 is brought into contact with a lower portion of the cap 27, which switches the piston 25 to an upper position (engaging position).

There is formed an operation window 29 in a left surface of the high-speed cylinder portion 17, and also a run-off 30 as a recess in a left surface of the piston 25. When the piston 25 is located in the lower position shown in FIG. 5, the run-off 30 of the piston 25 is exposed leftward through the operation window 29. When the piston 25 is placed in the upper position shown in FIG. 6, an outer circumferential surface of the piston 25 is exposed through the operation window 29. The compression spring 28 of the high-speed cylinder portion 17 has a smaller diameter but a greater length than the compression spring 21 of the low-speed cylinder portion 16, to thereby secure a prescribed biasing force applied to the piston 25. Moreover, the compression spring 28 is located offset with respect to an axis of the high-speed cylinder portion 17 and held in a spring hole 25*a* that is formed in the piston 25 to prevent from being bent by compression.

As illustrated in FIGS. 2 and 3, a boss portion 33 of the low-speed drive rocker arm 32 (second rocker arm) is located in front of the intake driven rocker arm 11 on the intake rocker shaft 3 and pivotably supported on the intake rocker shaft 3. In the right side of the boss portion 33, there is a bias portion 33*a* protruding downward. The entire low-speed drive rocker arm 32 is biased in a valve-closing direction by a bias spring, not shown, coupled with the bias portion 33*a*. Accordingly, a roller 35 disposed in the left side is brought into contact with the low-speed cam 6 as shown in FIG. 7.

An operation arm portion 36 (first engaging projection) extends from an upper-side position of the roller 35 of the low-speed drive rocker arm 32 in a rearward direction along the axis of the camshaft 2. The operation arm portion 36 has a tip end that is bent into an L-shape toward the intake driven rocker arm 11 located in the right side thereof, to thereby face the operation window 22 of the low-speed cylinder portion 16. The low-speed drive rocker arm 32 is oscillated along the shape of the low-speed cam 6 while rotating the roller 35 on the low-speed cam 6 that is in rotation. In a base circular zone (zone in which a lift amount is 0) of the low-speed cam 6, the low-speed drive rocker arm 32 is oscillated in the valve-closing direction to separate the tip end of the operation arm portion 36 from the operation window 22 in the leftward direction as shown by a solid line in FIG. 4. In a lift zone of the low-speed cam 6, on the contrary, the low-speed drive rocker arm 32 is oscillated in a valve-opening direction to insert the tip end of the operation arm portion 36 into the operation window 22 as shown by a chain double-dashed line in FIG. 4.

There is formed a boss portion 39 in the high-speed drive rocker arm 38 (third rocker arm), the boss portion 39 being located at the rear of the intake driven rocker arm 11 on the intake rocker shaft 3 and pivotably supported on the intake rocker shaft 3. As is the case with the low-speed drive rocker arm 32, the high-speed drive rocker arm 38 is biased by a bias spring, not shown, in the valve-closing direction through a bias portion 39*a,* to thereby bring a roller 40, which is provided in the left side, into contact with the high-speed cam 9 as illustrated in FIG. 7.

An operation arm portion 41 (second engaging projection) extends from an upper-side position of the roller 40 of the high-speed drive rocker arm 38 in a frontward direction along the axis of the camshaft 2. The operation arm portion 41 has a tip end that is bent into an L-shape toward the intake driven rocker arm 11 located in the right side thereof, to thereby face the operation window 29 of the high-speed cylinder portion 17. Like the low-speed drive rocker arm 32, the high-speed drive rocker arm 38 is oscillated along a shape of the high-speed cam 9 while rotating the roller 40 on the high-speed cam 9. In a base circular zone of the high-speed cam 9, the high-speed drive rocker arm 38 is oscillated in the valve-closing direction to separate the tip end of the operation arm portion 41 from the operation window 29 in the leftward direction as shown by a solid line in FIG. 5. In a lift zone of the high-speed cam 9, on the contrary, the high-speed drive rocker arm 38 is oscillated in the valve-opening direction to insert the tip end of the operation arm portion 41 into the operation window 29 as shown by a chain double-dashed line in FIG. 5.

According to the present embodiment, a first switching mechanism M1 is constituted by the lower and upper pistons 18*a* and 18*b* of the low-speed cylinder portion 16, the piston 25 of the high-seed cylinder portion 17, the operation arm portion 36 of the low-speed drive rocker arm 32, and the operation arm portion 41 of the high-speed drive rocker arm 38.

Exhaust-Side Valve Gear

Contrary to the intake-side valve gear, the exhaust-side valve gear does not include the high-speed cylinder portion 17 of the intake driven rocker arm 11 and the high-speed drive rocker arm 38 corresponding thereto. A configuration of the exhaust-side valve gear will be described below.

As illustrated in FIGS. 2 and 3, the exhaust rocker shaft 4 is fitted in a bearing bore 44*a* of a boss portion 44 (second support portion) of an exhaust driven rocker arm 43 (fourth rocker arm). The entire exhaust driven rocker arm 43 can be oscillated around the exhaust rocker shaft 4. Extending leftward from the boss portion 44 are two valve-side arm portions 45 formed into a biforked shape. Each valve-side arm portion 45 has a tip end provided with an adjust bolt 46 corresponding to an exhaust valve, not shown, attached onto the cylinder head 1.

Referring to FIG. 7, the boss portion 12 of the intake driven rocker arm 11 and the boss portion 44 of the exhaust driven rocker arm 43 are arranged in the right and left sides of the camshaft 2, respectively. In addition, the boss portions 12 and 44 partly overlap each other in an axial direction of the camshaft 2. As shown in FIGS. 7 and 8, a cam-side arm portion 47 (second contact portion) extends from the boss portion 44 in the rightward direction. Formed in a tip end of the cam-side arm portion 47 is a sliding-contact portion 47*a,* which is in contact with the suspension cam 8 while avoiding interference with the sliding-contact portion 15*a* of the intake driven rocker arm 11. Herein, the cam-side arm 15 of the intake driven rocker arm 11 and the cam-side arm 47 of the exhaust driven rocker arm 43 are located side by side on the suspension cam to overlap each other, as viewed in the axial direction of the camshaft 2.

In the above-described state, if the exhaust driven rocker arm 43 is oscillated counterclockwise, the exhaust valves are opened against the valve springs through the adjust bolts 46 of the valve-side arm portions 45. Hereinafter, an oscillating direction of members constructing the exhaust-side valve gear, including the exhaust driven rocker arm 43, an after-mentioned exhaust drive rocker arm 49 and the like, is defined as a valve-opening direction if the oscillating direction is counterclockwise, and a valve-closing direction if clockwise.

As illustrated in FIGS. 2 and 3, an annular cylinder portion 48 is integrally formed on the boss portion 44 of the exhaust driven rocker arm 43. The cylinder portion 48 has a configuration symmetrical to the low-speed cylinder portion 16 of the intake driven rocker arm 11 as shown in FIG. 3.

The cylinder portion 48 will be roughly described below with the same reference numerals as those for the low-speed cylinder portion 16. The lower piston 18*a* (a second portion of a third piston) and the upper piston 18*b* (a first portion of the third piston) are fitted in the lower cylinder 16*a* (one half of a third cylinder) and the upper cylinder 16*b* (another half of the third cylinder) of the cylinder portion 48, respectively, to be slidable in the vertical direction. The pistons 18*a* and 18*b* are downwardly biased by the compression spring 21. When the pistons 18*a* and 18*b* are in the lower positions as shown in FIG. 3, the lower surface of the lower piston 18*a* is brought into contact with the outer circumferential surface of the exhaust rocker shaft 4, and at the same time, the outer circumferential surface of the upper piston 18*b* is exposed from the operation window 22 of the cylinder portion 48 in the rightward direction. If the pistons 18*a* and 18*b* are in the upper positions as shown in FIG. 4, the run-off 23 of the upper piston 18*a* is exposed from the operation window 22 in the rightward direction.

The members including the lower piston 18*a,* the upper piston 18*b,* the cap 19, the compression spring 21 and the like are commonly used to be accommodated in the exhaust-side cylinder portion 48 and in the intake-side low-speed cylinder portion 16.

As illustrated in FIGS. 2 and 3, the exhaust drive rocker arm 49 (fifth rocker arm) is located in front of the exhaust driven rocker arm 43 on the exhaust rocker shaft 4 and pivotably supported on the exhaust rocker shaft 4. The exhaust drive rocker arm 49 has a configuration symmetrical to the intake-side low-speed drive rocker arm 32.

The exhaust drive rocker arm 49 will be roughly described with the same reference numerals as those for the low-speed drive rocker arm 32. The exhaust drive rocker arm 49 is biased by a bias spring, not shown, in the valve-closing direction through the bias portion 33*a,* to thereby bring the roller 35, which is provided in the right side thereof, into contact with the exhaust cam 7. Extending from the exhaust drive rocker arm 49 in the rear direction is the operation arm portion 36. The operation arm portion 36 has the tip end that is bent leftward to have an L-shape, to thereby face the operation window 22 of the cylinder portion 48 of the exhaust driven rocker arm 43. The exhaust drive rocker arm 49 is oscillated along the shape of the exhaust cam 7 while rotating the roller 35. In the base circular zone of the exhaust cam 7, the exhaust drive rocker arm 49 is oscillated in the valve-closing direction to separate the tip end of the operation arm portion 36 from the operation window 22 in the rightward direction as shown by a solid line in FIG. 4. In the lift zone of the exhaust cam 7, the exhaust drive rocker arm 49 is oscillated in the valve-opening direction to insert the tip end of the operation arm portion 36 into the operation window 22 as shown by a chained double-dashed line in FIG. 4.

According to the present embodiment, a second switching mechanism M2 is constituted by the lower and upper pistons 18*a* and 18*b* of the cylinder portion 48, and the operation arm portion 36 of the exhaust drive rocker arm 49.

Descriptions about the valve gear for one cylinder of the suspension cylinder bank have been completed. The other cylinders each have a configuration identical to the aforementioned one.

Oil Path

Referring to FIGS. 1 and 2, an oil path 51 for cylinder suspending mode and an oil path 52 for high-speed mode are formed in the intake rocker shaft 3 along the axial direction thereof. The oil paths 51 and 52 each have front and rear ends that are open in front and rear end surfaces of the intake rocker shaft 3, respectively. The front end of the oil path 51 is sealed with a plug 53, and one end of an L-shaped metal pipe 54 is pressed and fixed into the rear end of the oil path 51. The front end of the oil path 52 is connected to an oil control valve (which serves as control means and is hereinafter referred to as OCV) 55 for high-speed mode via an oil supply path, not shown, formed in the cylinder head 1. The rear end of the oil path 52 is blocked with a plug 56.

In the exhaust rocker shaft 4, an oil path 57 for cylinder suspending mode is formed along the axial direction of the shaft 4. The oil path 57 has front and rear ends that are open in front and rear end surfaces of the exhaust rocker shaft 4, respectively. The front end of the oil path 57 is connected to an OCV 58 for cylinder suspending mode via an oil supply path, not shown, formed in the cylinder head 1. One end of an L-shaped metal pipe 59 is pressed and fixed into the rear end of the oil path 57. The other ends of the intake-side and exhaust-side metal pipes 54 and 59 face each other with a prescribed distance therebetween and interfitted with respective ends of a rubber hose 60 to be connected to each other.

The OCV 55 for high-speed mode and the OCV 58 for cylinder suspending mode receive oil supply from a lubricating oil pump, not shown, provided to the engine, and are switching-controlled by an ECU 61 (which serves as control means and is an abbreviation for "engine control unit") that is mounted on the vehicle, to thereby appropriately supply oil to the oil path 52 for high-speed mode and the oil path 57 for cylinder suspending mode.

As illustrated in FIGS. 2 and 3, communication paths 63 are formed in three places (drawings show only one) of the intake rocker shaft 3 to correspond to the low-speed cylinder portions 16 of the intake driven rocker arms 11 of the cylinders concerned. Each communication path 63 has a lower end communicating with the oil path 51 for cylinder suspending mode and an upper end that is open in the outer circumferential surface of the intake rocker shaft 3 and communicates with the lower cylinder 16*a* of each low-speed cylinder portion 16.

Referring to FIGS. 2 and 5, communication paths 64 are formed in three places (drawings show only one) of the intake rocker shaft 3 to correspond to the high-speed cylinder portions 17 of the intake driven rocker arms 11 of the cylinders concerned. Each communication path 64 has a lower end communicating with the oil path 52 for high-speed mode and an upper end that is open in the outer circumferential surface of the intake rocker shaft 3 and communicates with the cylinder 17*a* of each high-speed cylinder portion 17.

As is clear from FIGS. 2 and 3, communication paths 65 are formed in three places (drawings show only one) of the exhaust rocker shaft 4 to correspond to the cylinder portions 48 of the exhaust driven rocker arms 43 of the associated cylinders. Each communication path 65 has a lower end communicating with the oil path 57 for cylinder suspending mode and an upper end that is open in the outer circumferential surface of the exhaust rocker shaft 4 and communicates with the lower cylinder 16*a* of each cylinder portion 48.

Non-Suspension Cylinder Bank

A valve gear of a non-suspension cylinder bank has no cylinder suspending mechanism and has only a switching mechanism for switching between the low-speed mode and the high-speed mode. A concrete configuration of the valve gear of a non-suspension cylinder bank will be described hereinafter. In the intake side, the low-speed cylinder portions 16 of the intake driven rocker arm 11 and the low-speed drive rocker arm 32 are not provided (the high-speed cylinder portions 17 and the high-speed drive rocker arm 38 are maintained). The intake driven rocker arm 11 is oscillated directly by the low-speed cam 6 without the medium of the low-speed drive rocker arm 32, to thereby open and close the intake valve all the time.

In the exhaust side, the cylinder portion 48 of the exhaust driven rocker arm 43 and the exhaust drive rocker arm 49 do not exist. Therefore, the exhaust driven rocker arm 43 is oscillated directly by the exhaust cam 7 without the medium of the exhaust drive rocker arm 49, to thereby open and close the exhaust valve all the time. Since the intake and exhaust driven rocker arms 11 and 43 are constantly oscillated as stated, the suspension cam 8 of the camshaft 2 is not provided, either. Furthermore, the lack of the cylinder suspending mechanism entails the absence of the oil paths 51 and 57 for cylinder suspending mode, which are to be located in the intake and exhaust rocker shafts 3 and 4.

The following description is about an operating state of the valve gear with a cylinder suspending mechanism of the engine, which is configured in the aforementioned manner.

Switching control of the OCVs 55 and 58 is carried out by the ECU 61, based on engine speed Ne. For instance, the cylinder suspending mode (third mode) is activated in a rotation range where the engine speed Ne is less than a first threshold value Ne1, and an output demand to the engine is adequately low. The low-speed mode (first mode) is activated in a rotation range where the engine speed Ne falls in the range between the first threshold value Ne1 and a second threshold value Net (>Ne1), and ordinary engine output is required. The high-speed mode (second mode) is activated in a rotation range where the engine speed Ne is equal to or greater than the second threshold value Net, and particularly high engine output is required. Hereinafter, the operating state of the valve gear will be described with respect to each mode.

Low-Speed Mode

In the suspension cylinder bank, the ECU 61 switching-controls the OCV 55 for high-speed mode and the OCV 58 for cylinder suspending mode and discontinues the oil supply to the oil path 51 for cylinder suspending mode and the oil path 52 for high-speed mode.

As a result, in the low-speed cylinder portion 16 of the intake driven rocker arm 11 and the cylinder portion 48 of the exhaust driven rocker arm 43, the lower pistons 18*a* and the upper pistons 18*b* are held in the lower positions by a biasing force of the respective compression springs 21, and the outer circumferential surfaces of the upper pistons 18*b* are exposed through the respective operation windows 22, as shown in FIG. 3. As shown in FIG. 5, in the high-speed cylinder portion 17 of the intake driven rocker arm 11, the biasing force of the compression spring 28 holds the piston 25 in the lower position, and the run-off 30 is then exposed through the operation window 29.

During the operation of the engine, the low-speed drive rocker arm 32, the high-speed drive rocker arm 38, and the exhaust drive rocker arm 49 are constantly oscillated along the shapes of the corresponding cams 6, 7, and 9. Along with the oscillation, the tip ends of the operation arm portions 36 and 41 are inserted into and separated from the operation windows 22 and 29 of the driven rocker arms 11 and 43.

The high-speed drive rocker arm 38 independently strikes at the air with the tip end thereof inserted into and separated from the run-off 30 that is exposed through the operation window 29 of the high-speed cylinder portion 17. The high-speed drive rocker arm 38 does not oscillate the driven rocker arms 11 and 43 as the after-mentioned low-speed drive rocker arm 32 and exhaust drive rocker arm 49 do.

The low-speed drive rocker arm 32 and the exhaust drive rocker arm 49 press the outer circumferential surfaces of the upper pistons 18*b* exposed through the operation windows 22 of the low-speed cylinder portion 16 and the cylinder portion 48 when being oscillated in the valve-opening direction. By so doing, the drive rocker arms 32 and 49 oscillate the corresponding driven rocker arms 11 and 43 in the valve-opening direction, to thereby open the intake and exhaust valves. When the low-speed drive rocker arm 32 and the exhaust drive rocker arm 49 are oscillated in the valve-closing direction, the corresponding driven rocker arms 11 and 43 receive the biasing force of the valve springs, which is produced along with the closing of the intake and exhaust valves, and are then oscillated in the valve-closing direction.

Consequently, the intake driven rocker arm 11 is oscillated with the low-speed drive rocker arm 32 to open and close the intake valves along the shape of the low-speed cam. The exhaust driven rocker arm 43 is oscillated with the exhaust drive rocker arm 49 to open and close the exhaust valves along the shape of the exhaust cam.

In the non-suspension cylinder bank, since the ECU 61 discontinues the oil supply to the oil path 52 for high-speed mode from the OCV 55 for high-speed mode, the high-speed drive rocker arm 38 strikes the air as is the case with the suspension cylinder bank. Thus, the intake valves are driven to open and close along the shape of the low-speed cam 6, and the exhaust valves along the shape of the exhaust cam 7. As a consequence, in the low-speed mode, the engine output required within the ordinary rotation range is realized by using the low-speed cam 6 and the exhaust cam 7.

Cylinder Suspending Mode

While stopping the oil supply to the oil path 52 for high-speed mode in the suspension cylinder bank and the non-suspension cylinder bank, the ECU 61 supplies oil from the OCV 58 for cylinder suspending mode in the suspension cylinder bank.

The oil running from the OCV 58 flows through the oil path 57 of the exhaust rocker shaft 4 from the front side to the rear side to be supplied into the lower cylinder 16*a* of the exhaust driven rocker arm 43 via each communication path 65. The oil subsequently passes through the metal pipes 54 and 59 and the hose 60, and then flows through the oil path 51 of the intake rocker shaft 3 from the rear side to the front side. Eventually the oil is supplied into the lower cylinder 16*a* of the intake driven rocker arm 11 via each communication path 63.

In the lower cylinders 16*a* and the upper cylinders 16*b* of the intake driven rocker arm 11 and the exhaust driven rocker arm 43, the lower pistons 18*a* and the upper pistons 18*b* slide upward in response to hydraulic pressure of the supplied oil, resisting the compression spring 21, to be switched to the respective upper positions. This movement exposes the run-offs 23 of the lower pistons 18*a* through the respective operation windows 22. Therefore, the low-speed drive rocker arm 32 and the exhaust drive rocker arm 49 independently strike the air with the respective tip ends inserted into and separated from the run-offs 23 exposed through the operation windows 22 of the corresponding driven rocker arms 11 and 43, to thereby halt the oscillating operation with respect to the driven rocker arms 11 and 43.

Since the high-speed drive rocker arm 38 also strikes at the air, in each cylinder of the suspension cylinder bank, the intake and exhaust valves are kept closed due to the biasing force of the valve springs, and the intake driven rocker arm 11 and the exhaust driven rocker arm 43 are held at valve-closing positions while the sliding-contact portions 15*a* and 47*a* of the cam-side arms 15 and 47 are in contact with the suspension cam 8.

In the non-suspension cylinder bank, the operation of each cylinder is continued as in the low-speed mode, and the vehicle is operated by torque generated in the non-suspension cylinder bank. At the same time, the suspension of each cylinder in the suspension cylinder bank makes it possible to cut back on fuel consumption.

High-Speed Mode

In the suspension cylinder bank, the ECU 61 discontinues the oil supply to the oil path 51 for cylinder suspending mode from the OCV 58 for cylinder suspending mode, and on the other hand supplies oil to the oil path 52 for high-speed mode from the OCV 55 for high-speed mode.

In consequence, as in the low-speed mode, the outer circumferential surfaces of the upper pistons 18*b* are exposed through the respective operation windows 22 in the low-speed cylinder portion 16 of the intake driven rocker arm 11 and the cylinder portion 48 of the exhaust driven rocker arm 43.

The oil flowing in the oil path 52 is supplied through the communication path 64 into the cylinder 17*a* of the high-speed cylinder portion 17 in the intake driven rocker arm 11 of each cylinder. In the cylinder 17*a,* the piston 25 slides upward in response to the hydraulic pressure of the supplied oil, resisting the compression spring 28, to be switched to the upper position. The outer circumferential surface of the piston 25 is then exposed through the operation window 29.

As a result, in the exhaust side, the exhaust driven rocker arm 43 is oscillated with the exhaust drive rocker arm 49 along the shape of the exhaust cam 7, and the exhaust valve is driven to be open and close along the shape of the exhaust cam 7 as in the low-speed mode.

In the intake side, the pistons 18*b* and 25 of the low-cylinder portion 16 and the high-speed cylinder portion 17 are both exposed, and therefore can be pressed by the corresponding drive rocker arms 32 and 38. However, only the high-speed drive rocker arm 38 actually performs the pressing operation, and the low-speed drive rocker arm 32 strikes the air. This is because the high-speed cam 9 has a wider lift zone (or operation angle) and a greater lift amount, compared to the low-speed cam 6. In short, the intake valve is driven to be open and close along the shape of the high-speed cam 9 in the high-speed mode.

In the non-suspension cylinder bank as well as the suspension cylinder bank, oil is supplied to the oil path 52, and the intake valves are driven to be open and close along the shape of the high-speed cam 9. Consequently, in the high-speed mode, high engine output required in the high rotation range is realized by extending an opening period of the intake valves or by increasing the lift amount thereof, compared to the low-speed mode.

The valve gear with a cylinder suspending mechanism of the engine according to the present embodiment operates as stated above. According to the present embodiment, the low-speed drive rocker arm 32 and the high-speed drive rocker arm 38 are arranged in front and at the rear of the intake driven rocker arm 11 as stated, and the low-speed cylinder portion 16 and the high-speed cylinder portion 17 are disposed side by side in the intake driven rocker arm 11. Moreover, according to the sliding positions of the lower piston 18*a* and the upper piston 18*b* slidably fitted into the low-speed cylinder portion 16 and the piston 25 slidably fitted into the high-speed cylinder portion 17, the operation arm portions 36 and 41 extending from the low-speed drive rocker arm 32 and the high-speed drive rocker arm 38 are caused to perform pressing operation or to strike the air.

The exhaust drive rocker arm 49 is located in front of the exhaust driven rocker arm 43, and the cylinder portion 48 is provided in the exhaust driven rocker arm 43. According to the sliding positions of the lower piston 18*a* and the upper piston 18*b* slidably fitted into the cylinder portion 48, the operation arm portion 36 extending from the exhaust drive rocker arm 49 is caused to perform the pressing operation or to strike at the air.

As a consequence, in the intake side, the members, such as the low-speed cylinder portion 16, the high-speed cylinder portion 17, the low-speed drive rocker arm 32, and the high-speed drive rocker arm 38, are efficiently arranged around the intake driven rocker arm 11 to gather in one place. In the exhaust side, the members including the exhaust drive rocker arm 49 and the like are efficiently arranged around the exhaust driven rocker arm 43 to gather in one place. Therefore, the configuration of the valve gear including the cylinder suspending mechanism can be well-organized in the cylinder head 1, which makes it possible to achieve not only the downsizing of an entire valve gear mechanism but also the downsizing of the engine.

Furthermore, with the result that the members of the valve gear mechanism are arranged to gather in one place, the cylinder portions 16, 17, and 48 of the driven rocker arms 11 and 43 and the drive rocker arms 32, 38, and 49 are inevitably made closer to one another, and the tip ends of the operation arm portions 36 and 41 extending from the drive rocker arms 32, 38, and 49 then face the cylinder portions 16, 17, and 48 at the substantially shortest distance. Therefore, the operation arm portions 36 and 41 can be reduced to the minimum in length. Consequently, it is possible to decrease the weight of the drive rocker arms 32, 38, and 49 while ensuring enough strength by forming these arms into efficient shapes, which encourages a reduction in inertial weight of the entire valve gear.

According to the present embodiment, the sliding-contact portions 15*a* and 47*a* of the cam-side arm portions 15 and 47 of the intake driven rocker arm 11 and the exhaust driven rocker arm 43 are brought into contact with the common suspension cam 8 in the cylinder suspending mode. Factors in achievement of the above configuration, and operation and advantages obtained due to the configuration will be described below in detail.

As is obvious from FIGS. 2 and 7, the low-speed and high-speed drive rocker arms 32 and 38 are located in front and at the rear of the intake driven rocker arm 11, and the exhaust drive rocker arm 49 in front of the exhaust driven rocker arm 43. Disposed in between the low-speed cam 6 and the high-speed cam 9 for driving the low-speed and high-speed drive rocker arms 32 and 38 are the exhaust cam 7 for driving the exhaust drive rocker arm 49 and the suspension cam 8 for cylinder suspending mode.

Since the exhaust cam 7 is so located as to substantially correspond to the exhaust drive rocker arm 49 in the axial direction of the camshaft 2, there is formed a dead space on the camshaft 2 at the position corresponding to the exhaust driven rocker arm 43, and the suspension cam 8 is disposed in the dead space.

In consequence of the application of the above layout, it is possible to open and close the intake and exhaust valves according to the mode switches by means of the driven rocker arms 11 and 43 that individually function. Furthermore, it is also possible-to bring the sliding-contact portions 15*a* and 47*a* of the cam-side arm portions 15 and 47 extending from the intake and exhaust driven rocker arms 11 and 43 into contact with the common suspension cam 8. As a result, there simply has to be provided the single suspension cam 8 per cylinder on the camshaft 2. This makes it possible to shorten the entire length of the camshaft 2 and to reduce man-hours required to manufacture the camshaft 2, thereby lowering the cost of production, in comparison with the engine disclosed in Japanese provisional patent publication No. 2002-201921, which requires a pair of suspension cams per cylinder.

The suspension cam 8 may be narrow in view of the function if it simply serves to control the oscillation of the driven rocker arms 11 and 43. Due to restrictions for the processing of a cam, however, the suspension cam 8 needs to be located at some distance from an adjacent cam. To be concrete, in order to avoid interference of a grindstone with the adjacent cam when the suspension cam 8 is polished or in order to facilitate the work of removing burr of the polished cam, there needs to be a space between the suspension cam 8 and the adjacent cam. Therefore, each of the suspension cams 8 requires a considerable occupied space in the axial direction of the camshaft 2, and moreover as many occupied spaces as cylinders are required. Unlike the valve gear disclosed in the above Publication No. 2002-201921 which requires a pair of suspension cams per cylinder, the valve gear of the present embodiment functions by using the single suspension cam 8, and therefore, the entire length of the camshaft 2 can be shortened to a large degree.

Furthermore, not only the cams 6 through 9 located on the camshaft 2 but also the intake and exhaust driven rocker arms 11 and 43 and the intake and exhaust drive rocker arms 32, 38 and 49 can be efficiently arranged without waste. This makes it possible to achieve the downsizing of the entire valve gear and therefore to accomplish the downsizing of the engine as well.

Additionally, in the layout of the above-described valve gear, the boss portion 12 of the intake driven rocker arm 11 and the boss portion 44 of the exhaust driven rocker arm 43 partly overlap each other as shown in FIG. 7. In other words, the intake and exhaust driven rocker arms 11 and 43 substantially face each other with the suspension cam 8 therebetween, so that the cam-side arm portions 15 and 47 extending from the boss portions 12 and 44 cause the sliding-contact portions 15*a* and 47*a* to contact the suspension cam 8 at the substantially shortest distance. Consequently, the weight of the intake and exhaust driven rocker arms 11 and 43 can be reduced while enough strength thereof is secured by forming these arms into efficient shapes at the same time, and the inertial weight of the entire valve gear can be reduced.

The operation arm portions 36 and 41 of the low-speed drive rocker arm 32, the high-speed drive rocker arm 38, and the exhaust drive rocker arm 49 are so formed as to extend along the axial direction of the camshaft 2. The operation arm portions 36 and 41 have the respective tip ends bent into an L-shape toward the corresponding cylinder portions 16, 17, and 48, to thereby face the operation windows 22 and 29. Accordingly, as is the case with the cam-side arm portions 15 and 47 of the driven rocker arms 11 and 43, the operation arm portions 36 and 41 of the drive rocker arms 32, 38, and 49 have the respective tip ends facing the operation windows 22 and 29 of the cylinder portions 16, 17, and 48 at the substantially shortest distance. This reduces the weight of the drive rocker arms 32, 38, and 49 while ensuring enough strength by forming these arms into efficient shapes, which encourages a reduction in the inertial weight of the entire valve gear.

Although the explanation of the embodiment has been completed, the form of the present invention is not limited to the above embodiment. For instance, the invention is applied to the V-six cylinder gasoline engine having four valves per cylinder in the above embodiment. As long as the engine is one having a valve gear with a cylinder suspending mechanism, however, the engine does not have to be a V-six cylinder gasoline engine in terms of category and type. On the contrary, the invention may be applied to for example a diesel engine or an in-line four-cylinder engine having two valves per cylinder.

According to the embodiment, the cylinder suspending mechanism is provided to not only the intake side but also the exhaust side in the suspension cylinder bank, and the exhaust valve is kept closed while the cylinder suspending mode is activated. For instance, however, the exhaust driven rocker arm 43 may be oscillated directly by the exhaust cam 7 without the cylinder suspending mechanism of the exhaust side.

In the embodiment, not only the piston 25 of the high-speed cylinder portion 17 but also the upper piston 18*b* of the low-speed cylinder portion 16 is exposed to enable the pressing operation in the high-speed mode. However, only the piston 25 of the high-speed cylinder portion 17 is actually pressed. Therefore, it is not necessary to expose the upper piston 18*b* of the low-speed cylinder portion 16, and the upper piston 18*b* may be maintained in the upper position which exposes the run-off 23.

According to the embodiment, the exhaust drive rocker arm 49 is supported in front of the exhaust driven rocker arm 43, and the exhaust cam 7 and the suspension cam 8 are disposed on the camshaft 2 to correspond to the rocker arms 43 and 49. However, the rocker arms 43 and 49, and also the cams 7 and 8, may be located the other way around in the longitudinal direction. In this case, too, it is still possible to achieve exactly the same operation and advantages as in the layout of the valve gear described in the embodiment.

Furthermore, in the embodiment, the pistons 18*a*, 48*b*, and 25 provided to the intake and exhaust driven rocker arms 11 and 43 are pressed or not pressed by using the operation arms 36 and 41 of the drive rocker arms 32, 38, and 49, to thereby oscillate the driven rocker arms 11 and 43 according to the mode switches. The configurations of the first and second switching mechanisms, however, are not limited to the above-mentioned configuration. For instance, like the engine disclosed in the above Publication No. 2002-201921, the drive rocker arms 32, 38, and 49 and the driven rocker arms 11 and 43 may be connected with or disconnected from one another with switch pins that slide in the axial direction of the camshaft 2.

What is claimed is:

1. A valve gear with a cylinder suspending mechanism of an internal combustion engine, comprising:

a first rocker arm having a tip end connected to either one of an intake valve and an exhaust valve and pivotably supported on a first rocker shaft;

a second rocker arm located at one side of said first rocker arm, pivotally supported on said first rocker shaft, and driven by a first cam formed in a camshaft;

a third rocker arm located at the other side of said first rocker arm, pivotally supported on said first rocker shaft, and driven by a second cam formed in the camshaft and having a cam shape different from said first cam;

a first switching mechanism for switching connection and disconnection of said first rocker arm with respect to said second or third rocker arm; and control means for controlling the switching of said first switching mechanism, wherein said first switching mechanism includes a first piston slidably fitted into a first cylinder formed in said first rocker arm, a second piston slidably fitted into a second cylinder formed in said first rocker arm, a first engaging projection extending from said third rocker arm and formed to be engageable with said second piston, and a second engaging projection extending from said third rocker arm and formed to be engageable with said second piston; and said first and second pistons are switched between an engaging position and a non-engaging position with respect to said first and second engaging projections.

2. The valve hear with a cylinder suspending mechanism of an internal combustion engine according to claim 1, wherein said control means controls the switching of said first switching mechanism so as to activate any one of a first mode in which said first rocker arm is driven by said first cam, a second mode in which said first rocker arm is driven by said second cam, and a third mode in which said first rocker is rendered inoperative.

3. The valve gear with a cylinder suspending mechanism of an internal combustion engine according to claim 2, wherein said control means controls the switching of said first switching mechanism, such that in said first mode, said first piston is located in the engaging position with respect to said first engaging projection, and said second piston in the non-engaging position with respect to said second engaging projection, and in said third mode, said first piston is located in the non-engaging position with respect to said first engaging projection, and said second piston in the non-engaging position with respect to said second engaging projection.

4. A valve gear with a cylinder suspending mechanism of an internal combustion engine, comprising:

a first rocker arm having a tip end connected to either one of an intake valve and an exhaust valve and pivotably supported on a first rocker shaft;

a second rocker arm located at one side of said first rocker arm, pivotably supported on said first rocker shaft, and driven by a first cam formed in a camshaft;

a third rocker arm located at the other side of said first rocker arm, pivotably supported on said first rocker shaft, and driven by a second cam formed in the camshaft and having a cam shape different from said first cam;

a fourth rocker arm having a tip end connected to the other one of the intake valve and the exhaust valve and pivotably supported on a second rocker shaft that is disposed in parallel to said first rocker shaft;

a fifth rocker arm located adjacent to said fourth rocker arm, pivotably supported on said second rocker shaft, and driven by a third cam;

a first switching mechanism for switching connection and disconnection of said first rocker arm with respect to said second or third rocker arm;

a second switching mechanism for switching connection and disconnection of said fourth rocker arm and said fifth rocker arm; and control means for controlling the switching of said first and second switching mechanisms, wherein, said first switching mechanism includes a first piston slidably fitted into a first cylinder formed in said first rocker arm, a second piston slidably fitted into a second cylinder formed in said first rocker arm, a first engaging projection extending from said second rocker arm and formed to be engageable with said first piston, and a second engaging projection extending from said third rocker arm and formed to be engageable with said second piston, and said first switching mechanism switches said first and second pistons between an engaging position and a nonengaging position with respect to said first and second engaging projections, and said second switching mechanism includes a third piston slidably fitted into a third cylinder formed in said fourth rocker arm and a third engaging projection extending from said fifth rocker arm and formed to be engageable with said third piston, and switches said third piston between an engaging position and a non-engaging position with respect to said third engaging projection.

5. The valve gear with a cylinder suspending mechanism of an internal combustion engine according to claim 4, wherein said control means controls the switching of said first and second switching mechanisms so as to activate any one of a first mode in which said first rocker arm is driven by said first cam, and said fourth rocker arm by said third cam, a second mode in which said first rocker arm is driven by said second cam, and said fourth rocker arm by said third cam, and a third mode in which said first and fourth rocker arms are rendered inoperative.

6. The valve gear with a cylinder suspending mechanism of an internal combustion engine according to claim 5, wherein said control means controls the switching of said first and second switching mechanisms, such that in said first mode, said first piston is located in the engaging position with respect to said first engaging projection, and said second piston in the non-engaging position with respect to said second engaging projection, and said third piston in the engaging position with respect to said third engaging projection, in said second mode, at least said second piston is located in the engaging position with respect to said second engaging projection, and said third piston in the engaging position with respect to said third engaging projection, and in said third mode, said first piston is located in the non-engaging position with respect to said first engaging projection, and said second piston in the nonengaging position with respect to said second engaging projection, and said third piston in the non-engaging position with respect to said third engaging projection.

7. The valve gear with a cylinder suspending mechanism of an internal engine according to claim 4, wherein said second cam is formed on the camshaft at a location away from said first cam in an axial direction, said third cam is formed in between said first cam and said second cam of said camshaft, and a fourth cam is formed in between said first or second cam and said third cam in said camshaft, and said first rocker arm and said fourth rocker arm are biased to contact a circumferential surface of said fourth cam.

8. The valve gear with a cylinder suspending mechanism of an internal combustion engine according to claim 7, wherein a first support portion of said first rocker arm associated with said first rocker shaft and a second support portion of said fourth rocker arm associated with said second rocker shaft are so arranged as to partly overlap each other with said fourth cam therebetween.

9. The valve gear with a cylinder suspending mechanism of an internal combustion engine according to claim 8, wherein said first support portion has a first contact portion formed to extend from said first support portion toward said second support portion above said fourth cam, and said second support portion has a second contact portion formed to extend from said second support portion toward said first support portion above said fourth cam in order not to interfere with said first contact portion.

10. The valve gear with a cylinder suspending mechanism of an internal combustion engine according to claim 9, wherein when said first and second pistons are located in the respective non-engaging positions with respect to said first and second engaging projections by using said first switching mechanism, and at the same time said third piston is located in the non-engaging position with respect to said third engaging projection by using said second switching mechanism, said first and fourth rocker arms are brought into contact with the circumferential surface of said fourth cam to be kept suspended.

11. The valve gear with a cylinder suspending mechanism of an internal combustion engine according to claim 4, wherein said first, second, and third engaging projections extending from said second, third and fifth rocker arms in an axial direction of the camshaft, respectively, and are each formed into an L-shape that swerves from an axis of the camshaft to be bent and elongated toward said first, second and third pistons, respectively.

12. The valve gear with a cylinder suspending mechanism of an internal combustion engine according to claim 7, wherein said first rocker arm and said fourth rocker arm are arranged side by side on said fourth cam so as to overlap each other, as viewed in the axis direction of the camshaft.

13. A valve gear with a cylinder suspending mechanism of an internal combustion engine, comprising:

a first rocker arm having a tip end connected to either one of an intake valve and an exhaust valve and pivotably supported on a first rocker shaft;

a second rocker arm located at one side of said first rocker arm, pivotally supported on said first rocker shaft, and driven by a first cam formed in a camshaft;

a third rocker arm located at the other side of said first rocker arm, pivotally supported on said first rocker shaft, and driven by a second cam formed in the camshaft and having a cam shape different from said first cam;

a first switching mechanism for switching connection and disconnection of said first rocker arm with respect to said second or third rocker arm; and control means for controlling the switching of said first switching mechanism, wherein, said first switching mechanism includes a first piston slidably fitted into a first cylinder formed in said first rocker arm, a second piston slidably fitted into a second cylinder formed in said first rocker arm, a first engaging projection extending from said third rocker arm and formed to be engageable with said second piston, and a second engaging projection extending from said third rocker arm and formed to be engageable with said second piston, said first and second pistons are switched between an engaging position and a non-engaging position with respect to said first and second engaging projections, wherein said control means controls the switching of said first switching mechanism so as to activate any one of a first mode in which said first rocker arm is driven by said first cam, a second mode in which said first rocker arm is driven by said second cam, and a third mode in which said first rocker is rendered inoperative, and wherein said control means controls the switching of said first switching mechanism, such that in said first mode, said first piston is located in the engaging position with respect to said first engaging projection, and said second piston in the non-engaging position with respect to said second engaging projection, and in said third mode, said first piston is located in the non-engaging position with respect to said first engaging projection, and said second piston in the non-engaging position with respect to said second engaging projection.

* * * * *